United States Patent [19]

Gabriel

[11] 4,275,524

[45] Jun. 30, 1981

[54] REMOVABLE TIRE FOR CONSTRUCTION SET JOINT ELEMENT

[75] Inventor: Richard J. Gabriel, Portland, Oreg.

[73] Assignee: Matrix Toys, Inc., Portland, Oreg.

[21] Appl. No.: 21,924

[22] Filed: Mar. 19, 1979

[51] Int. Cl.[3] ..... A63H 33/04

[52] U.S. Cl. ..... 46/23; 152/209 B; 301/63 PW

[58] Field of Search ..... 46/16, 17, 31, 23, 221, 46/201; 301/63 PW, 86, 97, 98; 152/151, 209, 301, 379.1, 384, 323, 380

[56] References Cited

U.S. PATENT DOCUMENTS

| | | | |
|---|---|---|---|
| 300,782 | 6/1884 | Koch | 152/379.1 X |
| 1,499,392 | 7/1924 | Melton | 152/384 |
| 1,576,924 | 3/1926 | Malloy | 152/379.1 X |
| 2,709,318 | 5/1955 | Benjamin | 46/23 X |
| 3,283,795 | 11/1966 | Schelkmann | 152/187 |
| 3,486,269 | 12/1969 | Fischer | 46/17 |
| 3,730,594 | 5/1973 | Zbikowski | 301/63 PW |
| 4,129,975 | 12/1978 | Gabriel | 46/29 X |

FOREIGN PATENT DOCUMENTS

| | | | |
|---|---|---|---|
| 630790 | 8/1927 | France | 46/23 |
| 803473 | 7/1936 | France | 152/384 |

*Primary Examiner*—F. Barry Shay

*Attorney, Agent, or Firm*—Chernoff & Vilhauer

[57] ABSTRACT

The present invention provides a tire arranged to circumscribe a spheroidal construction set joint element of the type having multiple facets located around its periphery each having a joint opening located therein. A portion of the facets circumscribe the joint element around a diametric axis and are arranged in a particularly defined pattern. The tire comprises an annular rim having a width slightly greater than the facets and is fabricated from a yieldable material so that it can be easily stretched for installation onto the joint element. The inner side of the tire includes a plurality of planar engaging surfaces, each having substantially the same shape as the joint element facets, arranged in the same pattern as the circumscribing facets. Accordingly, when the tire is placed over the joint element, the engaging surfaces mate with the facets to prevent rotation of the tire relative to the joint element. Extending inwardly from each of the engaging surfaces is a protrusion which snugly fits within a joint opening when the tire is placed over the joint element, thereby further securing the tire to the joint element. Upstanding lugs, having beveled corners, are located around the outer periphery of the tire at spaced intervals. The lugs are rectangular in cross-section and are spaced apart by a distance which is slightly greater than their width thereby allowing the lugs to serve the dual function of tire tread and gear teeth. An annular ring formed on the outer edge of each side of the tire defines the tire and serves as a white sidewall.

1 Claim, 5 Drawing Figures

REMOVABLE TIRE FOR CONSTRUCTION SET JOINT ELEMENT

BACKGROUND AND SUMMARY OF THE INVENTION

It is common in construction set toys to provide a circularly cross-sectioned element of one type or another which is capable of being rotatably attached to other elements in the set to provide a wheel. With such wheels it is also common to provide a flexible, annular ring which fits snugly over the wheel to serve as a tire, thereby enhancing the aesthetic appearance of the toy.

However, such tires commonly are in the form of a rubber "O" ring which fits over the rim of the wheel into a groove which is formed in the wheel for the purpose of carrying the tire. While tires of this type perform satisfactorily when new, after repeated removal and replacement they typically become stretched to the point where they no longer adhere to the rim. When this occurs they no longer function in a satisfactory manner. In addition, with tires of this type it is not economically feasible to place a tread design on the outer face of the tire, thereby making it a less than an ideal tire replica and not providing any traction capability.

While slip-on tires having lugs are known in the prior art, these primarily are in the form of a tractor tread comprising a thin belt which fits over a spaced-apart set of wheels. Accordingly, this type of tire also relies on elasticity of the tire to effectuate joinder between the tire and the wheel, and, when this type of tire becomes stretched with use it also slips relative to the wheel and eventually reaches a point where it will no longer function well as a tire either.

Furthermore, all of the prior art tires of this type require a specially configured wheel which is arranged for receiving the tire and for rotatable joinder to the rest of the elements of the construction set. Therefore, since the wheels must be produced separately from the other elements of the construction set and are not capable of serving any other purpose for the construction set, their cost is quite high and they typically are only provided with more expensive models of the set.

What is needed, therefore, is a tire which can be readily attached to a common pre-existing element of a construction toy set, which positively adheres mechanically to the construction set element and yet is easily removable therefrom, and which in addition has a lugged tread on its outer surface.

The present invention achieves these results by providing a tire for a construction set of the type having hollow, generally-spheroidal joint elements which include planar facets located around its periphery with joint openings located in each of the facets. The facets in the joint element are arranged so that a portion of them circumscribes the joint element in a particularly defined pattern around a diametric axis of the joint element. Also, the joint openings which lie along the axis, on both ends of the joint element, are circular, while the joint openings in the remainder of the facets are elongate. Therefore, a strut having a clip fastener which is shaped corresponding to the shape of the elongate joint openings will be fixed when attached to these openings and yet will be rotatable when attached to the round joint opening. As a result, by connecting one end of a short strut to a round joint opening in one joint element, and the other of the strut end to an elongate joint opening in another joint element, the former joint element will be rotatable with respect to the latter element. The rotatable joint element then serves as a wheel upon which the tire of the present invention is attached.

The tire comprises an annular rim having a width which is slightly greater than the width of the facets on the joint element and has a plurality of engaging surfaces on its inner face which mate with the facets on the joint element, thereby preventing rotation of the tire relative to the joint element once it is in place. In addition, elongate protrusions having the general shape of the elongate joint openings, extend inwardly from each of the engaging surfaces to seat within the joint openings when the tire is in place on the joint element, thereby further securing the tire to the joint element.

Located at spaced intervals around the outer periphery of the tire are upstanding lugs which are rectangular in cross section and which are spaced apart by a distance which is slightly greater than their width. Therefore, in addition to simulating tire tread the lugs serve as gear teeth which intermesh with the lugs on an adjacent tire.

Accordingly, it is a principal object of the present invention to provide a tire for attachment to a joint element of the class described which is firmly securable to the joint element and yet is easily removable.

It is a further object of the present invention to provide such a tire which is aesthetically similar to an actual lugged tire.

The foregoing objectives, features and advantages of the present invention will be more readily understood upon consideration of the following detailed description of the invention taken in conjunction with the accompanying drawings.

DETAILED DESCRIPTION OF THE INVENTION

Figure 1:
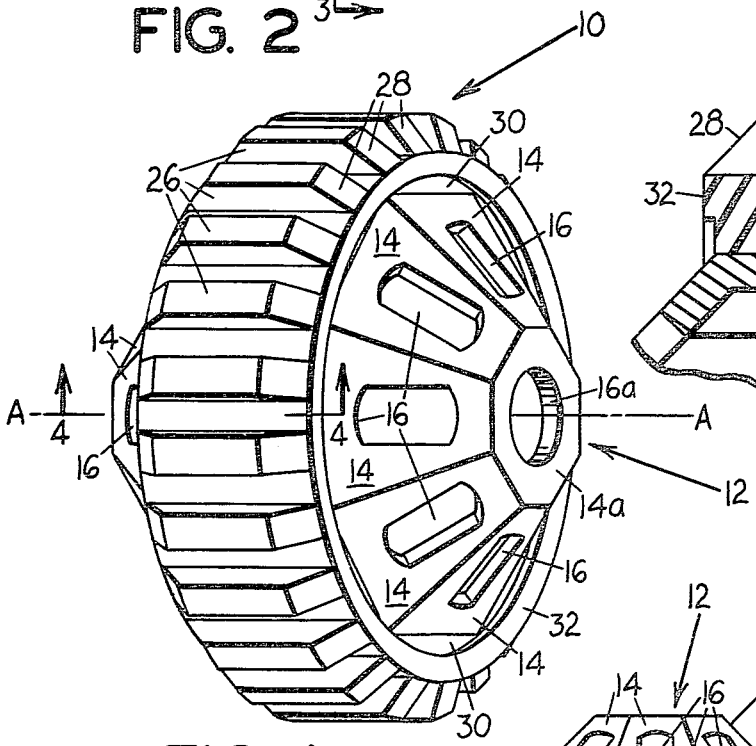
FIG. 1 is a perspective view showing a preferred embodiment of the tire of the present invention installed on a joint element.
Figure 4:
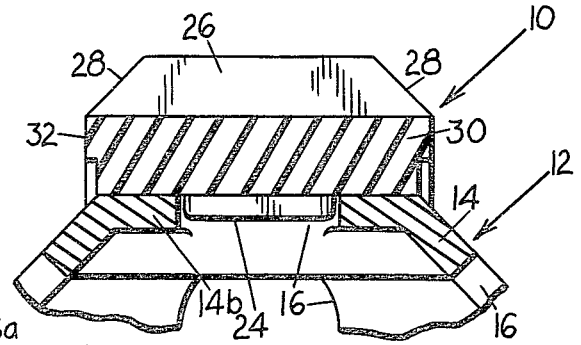
FIG. 4 is a fragmentary sectional view taken on the line 4—4 of FIG. 1.
Figure 5:
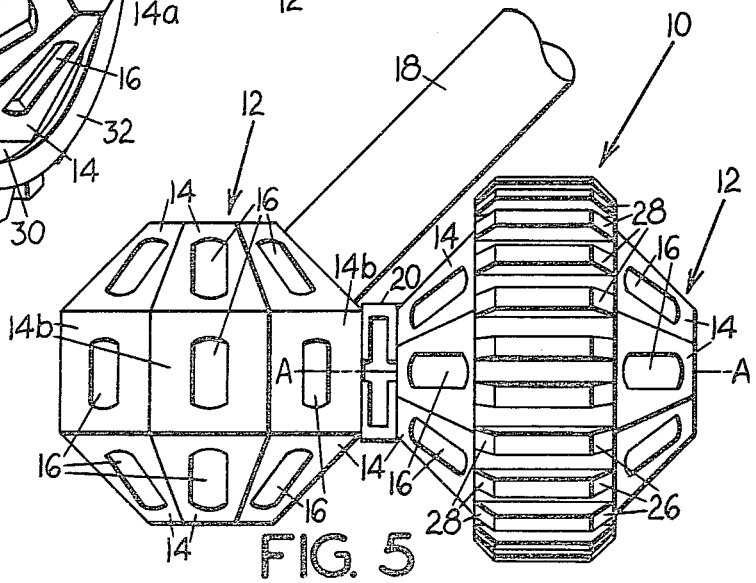
FIG. 5 is a side elevational view of a typical use of the tire and joint element.

Referring to FIG. 1 of the drawings, the tire 100 of the present invention is used with a construction set of the type shown in U.S. Pat. No. 4,129,975. More particularly it is used in conjunction with the joint element 12 of such a construction set. The joint element, which is also shown in FIG. 5, comprises a hollow, generally spheroidal structure, in this instance polygonal, having multiple facets 14 around its periphery and a joint opening 16 located in each of the facets. The joint element is arranged so that a portion of the facets **14*b*** circumscribe the joint element around a diametric axis A—A and these joint openings are positioned in a particularly defined pattern, which in the drawing is octagonal.

In the embodiment illustrated, all of the joint openings except the end joint openings **16*a*, which lie along axis A—A, are elongate with straight sides and semi-circular ends. The end joint openings 16*a* on the other hand are circular with a diameter which is substantially equal to the longer dimension of the elongate joint openings. Thus a strut 18, having located on each end a clip fastener (not shown) which has a shape corresponding to the shape of the elongate joint openings, will be fixed when attached to the elongate joint openings and will rotate when attached to the round joint openings. As a result, when two joint elements are joined together by a short strut 20, with the joint elements oriented at 90° with respect to one another, the joint element which is attached to the strut through the round joint opening 16***a*, the righthand joint element in FIG. 5, is free to rotate relative to the other joint element. Therefore, such a joint element serves as a wheel or similar rotary element. The tire of the present invention then is associated with a joint element which is used in this manner.

Figure 2:
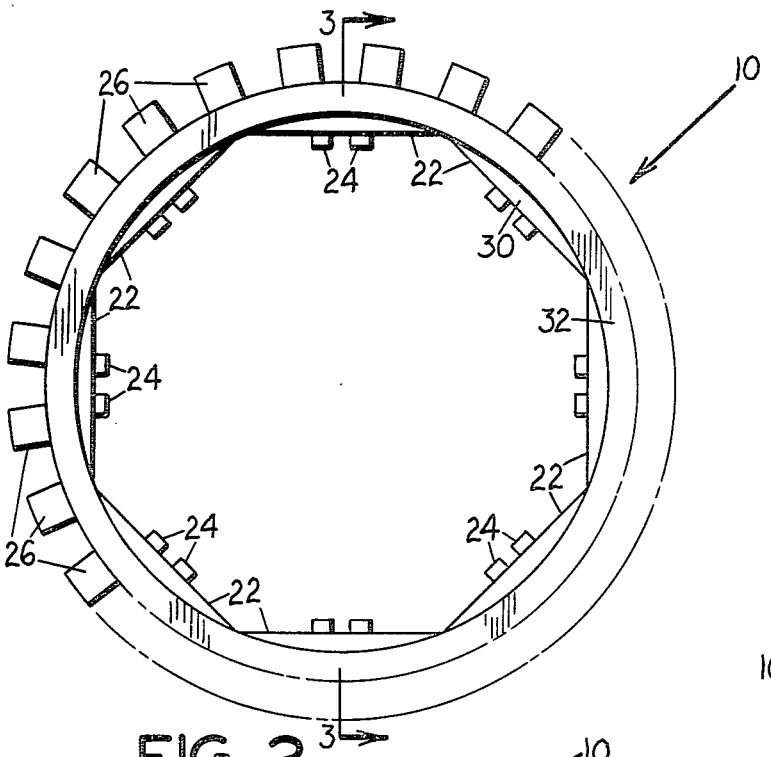
FIG. 2 is an end elevational view of the tire.
Figure 3:
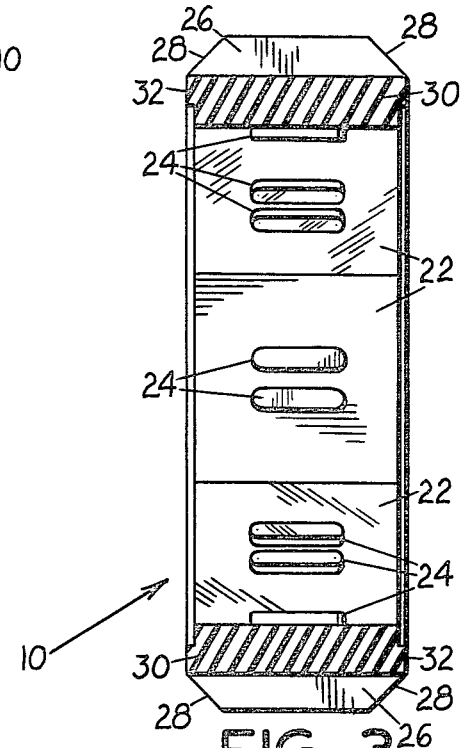
FIG. 3 is a sectional view taken on the line 3—3 of FIG. 2.

Referring to FIGS. 2 and 3, the tire 10 comprises an annular rim having a width which is slightly greater than the width of facets 14*b*. The tire is fabricated from a yieldable material, such as a soft plastic, allowing it to be easily stretched or deformed for installation onto the joint element.

The inner side of the tire includes a plurality of planar engaging surfaces 22, each having substantially the same shape as the facets 14*b*, which are arranged to conform with the cross-sectional shape of the joint element perpendicular to axis A—A. Accordingly, when the tire is placed over a joint element, the engaging surfaces 22 mate with facets 14to prevent rotation of the tire relative to the joint element.

Extending inwardly from each of the engaging surfaces is an elongate protrusion, such as paired, spaced-apart tabs 24. Each pair of tabs has a shape in cross section which tightly fits within the elongate joint openings 16. Thus the tire is rigidly secured to the joint element against lateral as well as circumferential displacement. However, by providing a pair of tabs, rather than a large single protrusion, cooling time is reduced in the die casting operation in which the tires are typically fabricated.

Located at spaced intervals around the outer periphery of the tire are upstanding lugs 26. The lugs preferably are rectangular in cross section and are separated by a distance which is slightly greater than their width so that in addition to simulating tire tread they serve as teeth thereby allowing the tire to interact with a like tire to function as mating gears.

In addition, the lugs have beveled corners 28 which allow clearance from a strut 18 which is attached to a diagonal facet on the joint element 12 to which the joint element carrying the tire is rotatably attached, as is best shown in FIG. 5. If it were not for the beveled corners 28 a strut located in the manner shown would interfer with the tire.

In the embodiment shown the width of the tire is of slightly greater width than the facets 14*b* with which it is associated. Therefore, by offsetting inwardly part-circular pads 30, which define the engaging surfaces 22, a raised annular ring 32 is created on each side of the tire below the lugs 26. This ring accents the tire and serves as a white sidewall.

The terms and expression which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tire for a generally spheriodal construction set joint element of the type having multiple planar facets with joint openings located therein, with a portion of said facets circumscribing said joint element in a particular defined pattern, said tire comprising:

(a) a yieldable annular rim having a width substantially equal to the width of said facets;

(b) lugs located at spaced intervals around said rim on the outer surface thereof;

(c) a plurality of planar engaging surfaces located on said rim on the inner side thereof, said engaging surfaces being arranged in the shape of said particularly defined pattern, and being substantially the same size as said portion of said facets so that each one of said surfaces is located adjacent to an associated one of said portion of said facets when said tire is positioned around said joint element;

(d) wherein said rim has a width which is slightly greater than the width of said portion of said facets, and includes opposed side walls each comprising:

(1) a thin annular ring having a radially outer margin which is coincident with the radially inward extremity of said lugs, and a radially inner margin which intersects lines formed between the common edges of adjacent ones of said engaging surfaces; and (2) a plurality of pads, having the cross-sectional shape of a circular segment which extend between said ring and said engaging surfaces and which are offset inwardly from said ring.

* * * * *

UNITED STATES PATENT AND TRADEMARK OFFICE

CERTIFICATE OF CORRECTION

PATENT NO. : 4,275,524

DATED : June 30, 1981

INVENTOR(S) : Richard J. Gabriel

It is certified that error appears in the above-identified patent and that said Letters Patent are hereby corrected as shown below:

Col. 3, line 28 change "14" to read --14b--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*